United States Patent [19]

Johnson et al.

[11] 4,118,089

[45] Oct. 3, 1978

[54] FURNITURE DRAWER

[75] Inventors: Jerry Lynn Johnson, Portrero; Martin R. Liebhold, Los Angeles, both of Calif.

[73] Assignee: Landes Manufacturing Co., Los Angeles, Calif.

[21] Appl. No.: 794,950

[22] Filed: May 9, 1977

[51] Int. Cl.[2] ..... A47B 88/00

[52] U.S. Cl. ..... 312/351; 312/3; 248/99; 297/441

[58] Field of Search ..... 312/351, 3, 6; 297/226, 297/441; 248/95, 99; 5/353.1

[56] References Cited

U.S. PATENT DOCUMENTS

| | | | |
|---|---|---|---|
| 560,288 | 5/1896 | Vickers | 312/4 |
| 672,417 | 4/1901 | Field | 248/99 |
| 807,092 | 12/1905 | Russell | 248/99 |
| 1,232,195 | 7/1917 | Brager | 312/3 |
| 1,265,996 | 5/1918 | Cerny | 248/99 |
| 2,496,757 | 2/1950 | Sieling | 248/99 |
| 3,201,072 | 8/1965 | DuBois | 248/99 |
| 3,421,689 | 1/1969 | Reinzan | 248/99 |
| 3,529,766 | 9/1970 | Mott, Sr. et al. | 248/99 |

FOREIGN PATENT DOCUMENTS

| | | | |
|---|---|---|---|
| 520,313 | 4/1940 | United Kingdom | 297/441 |
| 765,094 | 1/1957 | United Kingdom | 297/441 |

*Primary Examiner*—Kenneth Downey
*Assistant Examiner*—Victor N. Sakran
*Attorney, Agent, or Firm*—William W. Haefliger

[57] ABSTRACT

A drawer for use in furniture defining drawer support slides comprises:

(a) a generally rectangular frame defining parallel peripheral guide rails for cooperation with said support slides whereby the drawer may be advanced and retracted, and (b) a basket having flexible walls supported by and hanging from said frame, whereby the basket may be collapsed upwardly toward a plane defined by the frame.

The basket walls may be removably attached to the frame, and the latter may be defined by inner and outer frame loop members defining slots to receive basket wall portions.

7 Claims, 4 Drawing Figures

FURNITURE DRAWER

BACKGROUND OF THE INVENTION

This invention relates generally to furniture construction, and more particularly concerns a drawer which occupies minimum space for shipment or storage, which consists of a few simple components which are readily assembled and disassembled, and which includes a basket which is removable for cleaning or replacement.

There is a constant need for furniture which is attractively designed and characterized as occupying minimum space for shipment or storage as in kit form, which may be quickly assembled by the user, and which is sturdy and durable. These requirements are not easily met in the case of cabinets with drawers, since drawers in particular are box-like and not readily capable of being collapsed.

SUMMARY OF THE INVENTION

It is a major object of the invention to provide a simple, sturdy cabinet drawer which is characterized as meeting the needs and requirements and having the advantages and described above. The drawer is cooperable with cabinet support slides, and basically comprises:

(a) a generally rectangular frame defining parallel peripheral guide rails for cooperation with said support slides whereby the drawer may be advanced and retracted, and (b) a basket having flexible walls supported by and hanging from said frame, whereby the basket may be collapsed upwardly toward a plane defined by the frame.

As will be seen, the frame typically defines slots through which upper portions of the basket walls are received proximate their removable attachment to the frame; the frame includes parallel members spaced apart to define the slots, and loops on the basket wall portions are receivable downwardly through such slots to receive retainers such as dowels which are larger in cross section than the slot widths to block retraction of the loops through the slots; the parallel members are advantageously and simple defined by inner and outer frame rod loops, each loop having four stretches joined by curved corners; and the corner of the inner loop may simply be joined to corners of the outer loop to form a rugged frame easily shipped with the basket collapsed upwardly into the plane of the frame.

These and other objects and advantages of the invention, as well as the details of an illustrative embodiment, will be more fully understood from the following description and drawings, in which:

DRAWING DESCRIPTION

Figure 1:
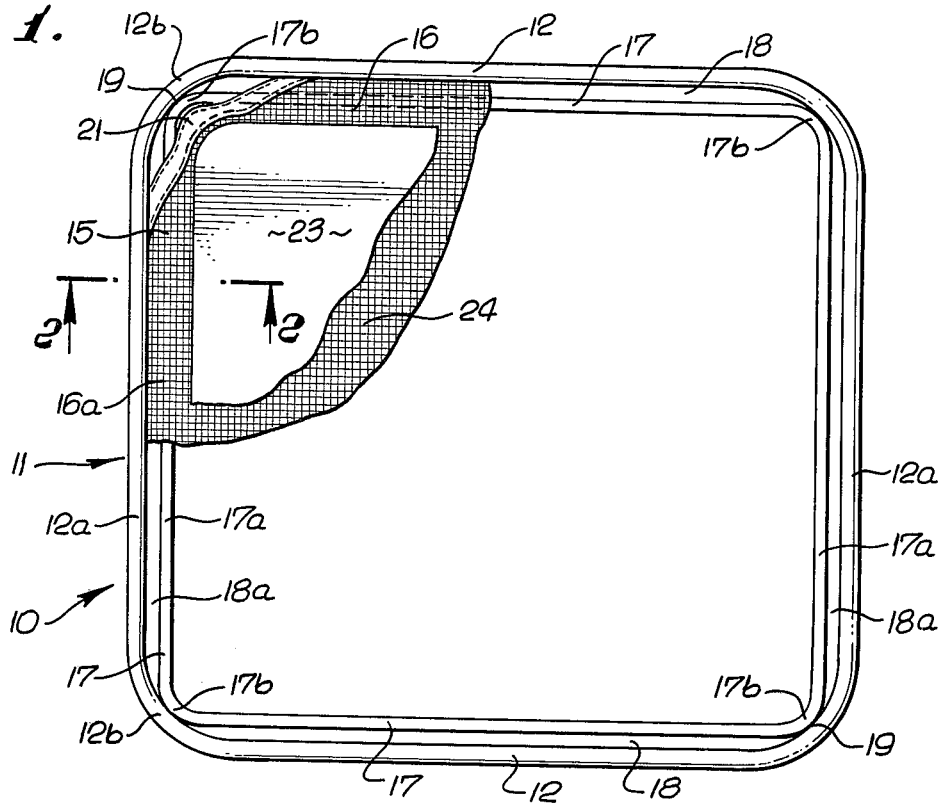
FIG. 1 is a plan view of a drawer embodying the invention.
Figure 2:
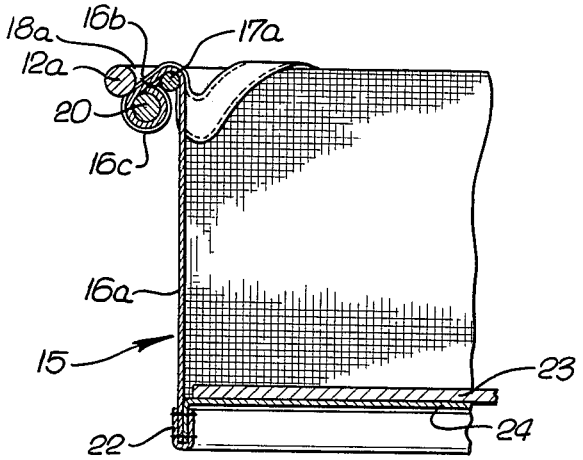
FIG. 2 is a section taken in elevation of FIGS. 2—2 of FIG. 1.
Figure 2A:
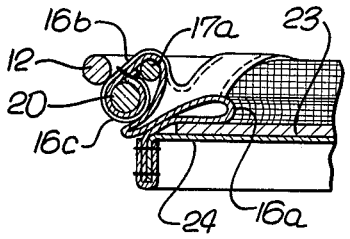
Figure 3:
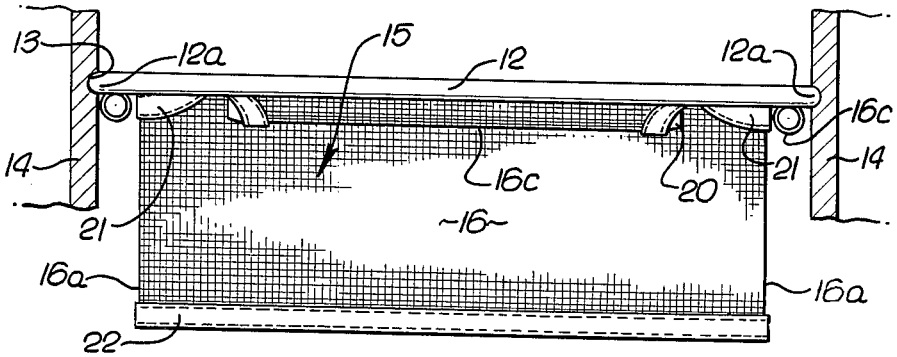

FIG. 2*a* is a view like FIG. 2, but showing the drawer basket in collapsed condition; and FIG. 3 is a side elevation showing the drawer in use.

DETAILED DESCRIPTION

In the drawings, the illustrated drawer 10 includes a generally rectangular, as for example square, frame 11. The latter defines peripheral guide rails, as at 12 and 12*a* for cooperation with support slides seen at 13 in FIG. 3. Such parallel horizontal slides are formed by notching the inner sides of walls 14 of a cabinet, for example.

The drawer also includes a basket indicated generally at 15, and having walls 16 and 16*a* hanging from the frame, whereby the basket may be collapsed upwardly toward a horizontal plane defined by the frame. See for example the downwardly extended condition of the basket in FIGS. 2 and 3, and its upwardly collapsed condition in FIG. 2*a*. Accordingly, the drawer or a series of drawers may be stacked in collapsed condition for low cost shipment, since required shipping space is minimized.

The frame will be understood as defining slots through which upper tab portions of the basket walls are received for removable attachment to the frame. For this purpose, the frame may with unusual advantage include parallel members 12 and 17 which are spaced apart to define slots 18, and parallel members 12*a* and 17*a* spaced apart to define slots 18*a*. Members 12 and 12*a* may be alike and interconnected by four turns 12*b* to form a continuous loop, which is approximately square; similarly, members 17 and 17*a* may be alike and interconnected by four turns 17*b* to form a continuous loop which is approximately square. The turns 17*b* are connected to the turns 12*b* as by welds at 19, whereby the like slots 18 and 18*a* are terminated at such connections. Accordingly, a simple, strong, frame is provided, and either of the two parallel sets of rails (provided by rod members 12 or 12*a*) may be inserted in the slides 13. The members 12, 12*a*, 17 and 17*a* may consist of circular cross-section metallic rod.

Referring to FIGS. 2 and 2*a*, the tab portion 16*b* of the basket wall 16*a* is extended over the inner frame member 17*a* and then down through slot 18*a*. A loop 16*c* is formed at the extremity of the tab portion 16*b*, and a retainer is extended lengthwise within the loop. The retainer may take the form of an elongated dowel 20 extending parallel to members 12*a* and 17*a*, and directly therebeneath for concealment. The dowel is diametrically larger than the slot, to block upward withdrawal of the loop through the slot, whereby the basket wall 16*a* is removably retained to the frame in a very simple manner. All four walls of the basket may be easily attached to the frame in this manner, as by the purchaser of a drawer kit that includes the frame, basket and dowels.

Reinforcement piping is indicated at 21 and 22, and attached to the basket material. Piping 22 extends peripherally about the lower portion of the basket within which a square stiffener panel 23 may be inserted and retained by the bottom wall 24. The basket may consist of lightweight, durable plastic which is perforated, i.e. foraminous for enhanced flexibility, to facilitate upward collapse as in FIG. 2*a*. Also, such a drawer insert basket may easily be removed from the frame, for cleaning or replacement.

I claim:

1. A drawer for use in furniture defining drawer support slides, comprising (a) a frame defining generally parallel peripheral guide rails cooperating with said support slides whereby the drawer may be advanced and retracted, and (b) a basket having flexible walls supported by and hanging from said frame, whereby the basket may be collapsed upwardly toward a plane defined by the frame, (c) the frame including elongated members which are spaced from said guide rails to define elongated slots, there being loops on the basket wall portions received through said slots, and there being retainers removably received in said loops and cooperating therewith to block retraction of the loops through the slots, said walls extending over said elongated members, (d) said slots included within at least three elongated slots defined by the frame.

2. The drawer of claim 1 wherein the frame is generally rectangular, there being four of said elongated slots.

3. The drawer of claim 1 wherein said retainers comprise dowels extending parallel to said members.

4. The drawer of claim 1 wherein said elongated members are joined to said guide rails at opposite ends of said slots.

5. The drawer of claim 1 wherein the frame defines curved corners at which said elongated members are joined to said guide rails.

6. The drawer of claim 7 wherein the upper portions of the basket walls are extended over the elongated members and down through the slops formed between the elongated members and guide rails, the loops located beneath said slots, there being a stiffener panel in the basket and extending adjacent to and over a basket bottom wall.

7. A drawer for use in furniture defining drawer support slides, comprising (a) a frame defining generally parallel peripheral guidr rails cooperating with said support slides whereby the drawer may be advanced and retracted, the guide rails being exposed, and (b) a basket having flexible walls supported by and hanging from said frame, whereby the basket may be collapsed upwardly toward a plane defined by the frame, (c) the frame including elongated members which are spaced from said guide rails to define elongated slots, there being loops on the basket wall portions received through said slots, and there being retainers removably received in said loops and cooperating therewith to block retraction of the loops through the slots; said walls extending over said elongated members, (d) said slots included within a plurality of elongaged slots defined by the frame, (e) said elongated members being joined to said guide rails at opposite ends of said slots, the upper portions of the basket walls being extended over the elongated members and down through the slots, the loops located beneath the slots.

* * * * *